United States Patent [19]

Elliott

[11] Patent Number: 4,497,091

[45] Date of Patent: Feb. 5, 1985

[54] TWIST CLIP

[76] Inventor: Jon S. Elliott, 305 Windsor, Park Forest, Ill. 60466

[21] Appl. No.: 476,429

[22] Filed: Mar. 18, 1983

[51] Int. Cl.[3] ..... B42F 1/02

[52] U.S. Cl. ..... 24/67.9; 24/545; 24/546; 24/563; D19/65

[58] Field of Search ..... 24/67.9, 67 R, 67.3, 24/67.5, 545, 546, 547, 548, 563, 564; D19/65

[56] References Cited

U.S. PATENT DOCUMENTS

| | | | |
|---|---|---|---|
| D. 20,412 | 12/1890 | Elst | 24/564 |
| D. 50,283 | 2/1917 | Peet | 24/DIG. 10 |
| D. 138,523 | 8/1944 | Sand | 24/563 |
| 1,378,890 | 5/1921 | Muck | 24/545 |
| 1,590,172 | 6/1926 | Thorberg | 24/546 |
| 1,996,447 | 4/1935 | Warager | 24/546 |
| 2,116,365 | 5/1938 | Schafer | 24/545 |
| 3,140,519 | 7/1964 | Johnson | 24/563 |
| 3,172,181 | 3/1965 | Fawick | 24/546 |
| 3,333,307 | 8/1967 | Wheeler | D19/65 |

FOREIGN PATENT DOCUMENTS

| | | | |
|---|---|---|---|
| 619662 | 3/1949 | United Kingdom | 24/67.9 |

*Primary Examiner*—Victor N. Sakran

[57] ABSTRACT

This invention is a spring steel wire clip used to clamp and grasp objects of various size and shape. Spring steel wire is bent to form a top area from which extend two legs, each in three segments; an upper part, a crossmember and a foot. Each upper part in conjunction with the top extend downward to form a plane on a different plane than a plane formed by the top and other upper part crossmembers extend inward from the upper parts and are substantially on the same plane yet do not cross over one another. Extending downward and outward from the crossmembers are feet which are parallel to the plane of the top and upper parts from which they extend and perform the gripping function of the invention.

The top is used as a grip to apply the clip in a twisting motion in relation to the object to be clamped such that the upper parts and crossmembers are reversed while the orientation of the feet remain constant resulting in a clamping action. This clip invention should be compared to similar wire form clips which are designed to hold a variety of sizes and shapes several times the weight of the clip itself. The clip of the invention herein differs from those known in that it is capable of clamping and holding a significantly wider range of sizes and shapes.

5 Claims, 7 Drawing Figures

TWIST CLIP

SUMMARY OF THE INVENTION

A spring steel wire is bent to form a horizontal top section from which two legs extend. Both legs are shaped identically, in planes distinctly separate from the other and consist of 3 segments; an upper part crossmember and foot. Each leg is directly generally downward and inward and then downward and outward forming a space where objects to be clamped are placed. In a set position the legs will intertwine and provide the desired clamping action.

In another embodiment of the invention objects of rounded or irregular shapes can be held more securely by extending the feet down and outward to form hooks which interlock.

The clamp of the invention is easily made on existing wire bending equipment and can be made from commercially available spring steel wire.

This invention should be compared to similar wire form clips which are designed to hold a wide variety of objects several times the weight of the clip itself.

These and other advantages of the twist clip are apparent in the following detailed description and drawing.

BRIEF DESCRIPTION OF THE DRAWING

FIG. #1 Is a drawing of the front elevation of the clip.

FIG. #2 Is a drawing of the side elevation of the clip in FIG. #1.

Figure 1:
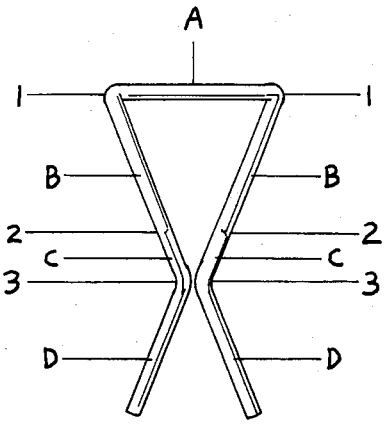
Figure 2:
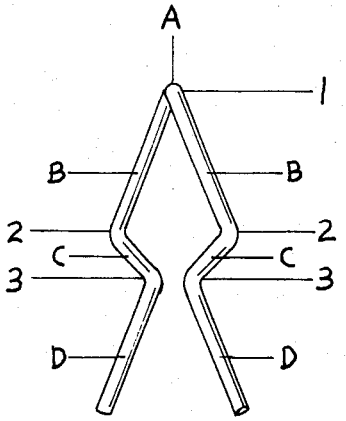
Figure 3:
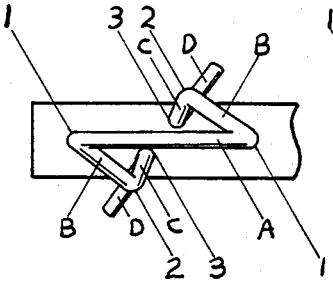
Figure 4:
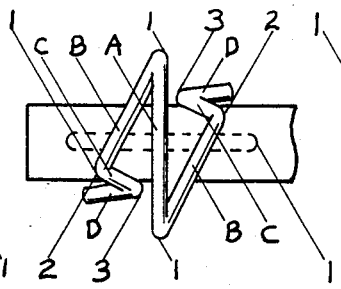
Figure 5:
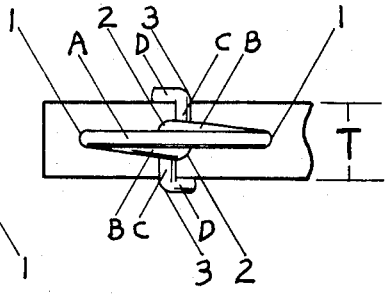
Figure 6:
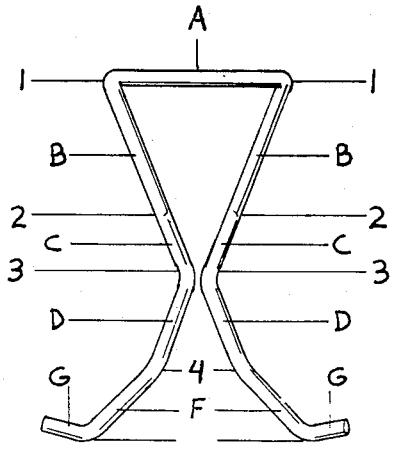
Figure 7:
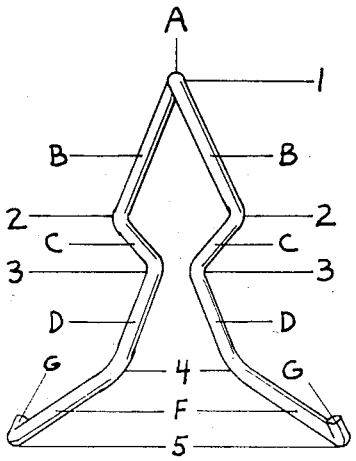

FIG. #3 Is a drawing of the top elevation of the clip of FIG. #1 with feet in position around an object.

FIG. #4 Is a drawing of the clip in FIG. #1 partially set around an object.

FIG. #5 Is a drawing of the clip in FIG. #1 set around an object.

FIG. #6 Is a drawing of the front elevation of another embodiment of the clip with feet extended to form hooks.

FIG. #7 Is a drawing of the side elevation of FIG. #6.

DETAILED DESCRIPTION

The following is a description of preferred specific embodiments of the new structure of this twist clip invention, such being made with reference to the drawings.

FIGS. #1 through #5 illustrate a clip of the invention both at rest and in conjunction with an object to be clamped. The thickness of the load(t) can vary from object to object and is representative only.

In FIG. #1 the clip is shown as extending downward from top A in a three part leg with each upper part B extending downward and inward at elbow 1, crossmembers C continuing downward and inward at elbow 2 and feet D extending downward and outward at elbow 3.

In FIG. #2 the clip is shown as extending downward from top A at elbows 1 to upper part B on distinctly individual planes and forming an angle meeting at top A. Extending again downward and inward from upper part B at elbow 2 is crossmember C, upper part B and crossmember C form an angle preferably greater than 90° and less than 180°, extending again downward and outward from crossmember C at elbow 3 is foot D, crossmember C and foot D form an angle is more than 90° and less than 180° and substantially parallel to the plane of upper part B and top A from which it extends.

In FIG. #3 the clip is shown with feet in place around an object, and shows upper part B extending at elbow 2 to crossmember C forming an angle of 90° with the line of crossmember C parallel to the line of the other crossmember C.

In FIG. #4 the invention has been rotated clockwise, in respect to the object approximately 90° bringing foot portions D into contact with the object.

In FIG. #5 the clip invention has been rotated to a fully set position of approximately 180° and illustrates the clamping action in effect, the feet in full contact with the object and crossmember C in contact with one another. The invention formed as illustrated in FIGS. #1–#5 show upper part B and top A providing the major clamping forces transmitted through elbow 2 to crossmember C to elbow 3 and foot D. Crossmembers C are in contact with one another and provide a setting/stopping point in the rotation of the clip.

FIGS. #6 & #7 show frontal and side elevations respectively of another embodiment of the invention whereby the feet portion of the clamp are extended to provide a grasping and interlocking feature. In this application feet D are extended outward at elbow 4 to grip F, and again to elbow 5 to locking arm G. In the set position a hooking action will be effected across grip F with elbow 5 and locking arm G completing the holding effect. In the fully set position this interlocking feature will provide a means of clamping and gripping rounded or irregular shaped objects with greater strength than would otherwise be possible.

While the preferred embodiments illustrated in FIGS.#6 & #7 are straight line they need not always be so.

I claim:

1. A clip formed of a rod of resilient material and having:

a top having opposed ends;

two legs, one at each end, depending from said top; each said leg having (a) an upper section joined to said top at a respective one of said ends, (b) a cross member connected to said upper section oppositely of said top and extending from said upper section at a first angle thereto; and (c) a foot joined to said cross member oppositely of said upper section and extending from said cross member at a second angle thereto;

said upper sections extending away from each other in a direction transverse to said top and towards each other in the direction of elongation of said top, said cross members extending from their respective upper section towards each other; and said feet being spaced and generally diverging away from each other; and being adapted to grasp an object disposed between said feet when said top is rotated approximately 180° relative to the object.

2. The clip of claim 1 wherein each said first angle is greater than about 90° and less than about 180° .

3. The clip of claim 1 wherein each said second angle is greater than about 90° and less than about 180° .

4. The clip of claim 1 wherein said feet have extensions directed to provide grasping and interlocking when an object has been placed between said feet and said top has been rotated approximately 180° .

5. A wire clip comprising:

an elongated top having ends;

a first leg attached to one of said ends and having a first section extending therefrom to one side of said top and toward the other of said ends, a second section joined to said first section oppositely of said top and extending angularly from said first section toward the other side of said top, and a foot section joined to and extending from said second section oppositely of said first section toward said one side and said one end of said top; and a second leg attached to the other of said ends and having a first section extending therefrom to the other side of said top and toward said one end, a second section joined to said first section oppositely of said top and extending angularly from said second leg first section toward said one side of said top, and a foot section joined to and extending from said second leg second section oppositely of said second leg second section toward said other side and said other end of said top;

said legs generally depending from said top and further generally extending away from the direction of elongation thereof with said feet being adapted to be disposed about an object to be grasped whereby rotation of said top relative to the object will cause the object to be clamped between said feet when said second sections are brought into contact with each other due to such rotation.

* * * * *